US005729810A

United States Patent [19]

Bergen et al.

[11] Patent Number: 5,729,810

[45] Date of Patent: Mar. 17, 1998

[54] OVERCOATED TRANSFER ROLLER FOR TRANSFERRING DEVELOPED IMAGES FROM ONE SURFACE TO ANOTHER

[75] Inventors: Richard F. Bergen, Ontario; Amy M. Opela, Penfield, both of N.Y.

[73] Assignee: Xerox Corporation, Stamford, Conn.

[21] Appl. No.: 479,237

[22] Filed: Jun. 7, 1995

Related U.S. Application Data

[63] Continuation-in-part of Ser. No. 7,208, Jan. 22, 1993, abandoned.

[51] Int. Cl.[6] ..... G03G 15/16

[52] U.S. Cl. ..... 399/313; 399/101; 399/297

[58] Field of Search ..... 399/66, 98, 99, 399/101, 297, 310, 313, 314, 318

[56] References Cited

U.S. PATENT DOCUMENTS

| | | | |
|---|---|---|---|
| 2,807,233 | 9/1957 | Fitch . | |
| 3,267,840 | 8/1966 | Honma et al. | 101/1 |
| 3,328,193 | 6/1967 | Oliphant et al. | 117/37 |
| 3,598,580 | 8/1971 | Baltazzi et al. | 96/1.4 |
| 3,625,146 | 12/1971 | Hutchinson | 101/153 |
| 3,630,591 | 12/1971 | Eastman . | |
| 3,684,364 | 8/1972 | Schmidlin . | |
| 3,691,993 | 9/1972 | Krause et al. . | |
| 3,702,482 | 11/1972 | Dolcimascolo et al. . | |
| 3,781,105 | 12/1973 | Meagher . | |
| 3,847,478 | 11/1974 | Young . | |
| 4,043,684 | 8/1977 | Lacroix | 403/8 |
| 4,401,383 | 8/1983 | Suzuki et al. . | |
| 4,931,839 | 6/1990 | Tompkins et al. . | |
| 4,947,214 | 8/1990 | Baxendell et al. . | |
| 5,010,370 | 4/1991 | Araya et al. . | |
| 5,038,178 | 8/1991 | Hosoya et al. . | |
| 5,101,238 | 3/1992 | Creveling et al. . | |
| 5,168,309 | 12/1992 | Adachi et al. . | |
| 5,172,173 | 12/1992 | Goto et al. . | |
| 5,187,524 | 2/1993 | Cherian . | |
| 5,191,378 | 3/1993 | Itaya et al. . | |
| 5,194,902 | 3/1993 | Kamimura et al. . | |
| 5,198,863 | 3/1993 | Goto et al. . | |
| 5,198,864 | 3/1993 | Fletcher . | |

FOREIGN PATENT DOCUMENTS

| | | |
|---|---|---|
| 0219072 | 9/1986 | Japan . |
| 0153682 | 5/1992 | Japan . |

*Primary Examiner*—Sandra L. Brase
*Attorney, Agent, or Firm*—William A. Henry, II

[57] ABSTRACT

An apparatus which transfers a developed image from a charge retentive surface to a copy sheet. The apparatus includes a transfer roller that is overcoated with an insulator and charged by either a brush, roller or a blade. The biased transfer roller is brought into contact with the back of a copy sheet thereby transferring charges that migrate through the copy sheet to enable toner transfer from the photoconductive surface to the copy sheet. A metal blade can be used to simultaneously charge and clean the transfer roller.

31 Claims, 5 Drawing Sheets

OVERCOATED TRANSFER ROLLER FOR TRANSFERRING DEVELOPED IMAGES FROM ONE SURFACE TO ANOTHER

This is a continuation-in-part of application Ser. No. 08/007,208, filed Jan. 22, 1993 now abandoned.

This invention relates to an electrophotographic printing machine, and more particularly concerns an apparatus for transferring a developed image from a photoconductive surface to a copy sheet.

In a conventional transfer station in xerography, a developed image of toner policies from the image developer material is transferred from a photoreceptor (the imaging surface) to a cut or roll fed copy sheet (the final image support surface), either directly or after an intermediate image transfer to an intermediate surface. Such image transfers are also required in other electrostatographic processing systems, such as electrophotoretic development. In "TESI" systems the intermediately transferred image may be an undeveloped latent electrostatic image.

Transfer is most commonly achieved by applying electrostatic force fields in a transfer nip sufficient to overcome the forces holding the toner to its original support surface and to attract most of the toner to transfer over onto the contacting second surface. These transfer fields are generally provided in one of two ways, by ion emission from a transfer corona generator onto the back of the copy sheet, as in U.S. Pat. No. 2,807,233, or by a D.C biased transfer roller or belt rolling along the back of the copy sheet. Examples of bias roller transfer systems are described in U.S. Pat. Nos. 2,807,233; 4,043,684; 3,267,840; 3,328,193; 3,598,580; 3,625,146; 3,630,591; 3,691,993; 3,702,482; 3,684,364; 3,781,105 and 3,847,478. A transfer system is shown in U.S. Pat. No. 4,947,214 in which a blade presses a copy sheet into contact with at least the developed image on a photoconductive surface.

The difficulties of successful image transfer are well known. In the pre-transfer (pre-nip) region, before the copy paper contacts the image, if the transfer fields are high, the image is susceptible to premature transfer across the air gap, leading to decreased resolution or fuzzy images Further, if there is ionization in the pre-nip air gap from high fields, it may lead to strobing or other image defects, loss of transfer efficiency, and a lower latitude of system operating parameters. Yet, in the directly adjacent nip region itself, the transfer field should be large as possible (greater than approximately 20 volts per micron) to achieve high transfer efficiency and stable transfer. In the next adjacent post-nip region, at the photoconductor/copy sheet separation area, if the transfer fields are too low, hollow characters may be generated. On the other hand, improper ionization in the post-nip region may cause image instability or copy sheet detacking problems. Variations in ambient conditions, copy paper, contaminants, etc. can all affect the necessary transfer parameters for simplex copying and especially for duplex copying.

Biased transfer rollers (BTR) offer a positive pressure to a copy sheet which can resolve transfer problems mentioned above in addition to problems due to cockles, folds and perforation pucker. Most require tailor-made resistance which is necessary to prevent arcing should the rollers come into contact with the photoconductor or receptor. Toner that is accidentally attached to the surface of the BTR can transfer to the back side of the copy sheet which makes cleaning of the BTR necessary. It also appears that the size of the conventional BTR (about 2–3 inches or more in diameter) contributes to a large pre and post nip breakdown zone formed adjacent either side of the receptor-to-copy paper contact zone which can lead to decreased resolution or fuzzy images.

In accordance with one aspect of the present invention, there is provided an apparatus for transferring a developed image from a photoconductive surface to a copy sheet. The apparatus includes a roller that is overcoated with an insulator that is made of a hard or soft material. The highly insulating surface is charged by a brush, roller or blade and is brought into contact with the back of a copy sheet thereby transferring charges that migrate through the paper to enable toner transfer from the photoconductive surface to the copy sheet. A blade cleans the insulating surface to prevent contamination of the back side of the copy sheet In another aspect of the present invention, there is provided an electrophotographic printing machine of the type in which a developed image is transferred from a photoconductive surface to a copy sheet at a transfer station. The improved printing machine includes a biased transfer roller that has a high voltage applied to its core and is covered by an insulator in order to achieve good transfer without air breakdown. The insulator is discharged by a grounded brush as it is cycled, however, the brush does not necessarily have to be grounded.

Other aspects of the present invention will become apparent as the following description proceeds and upon reference to the drawings, in which.

Figure 2:
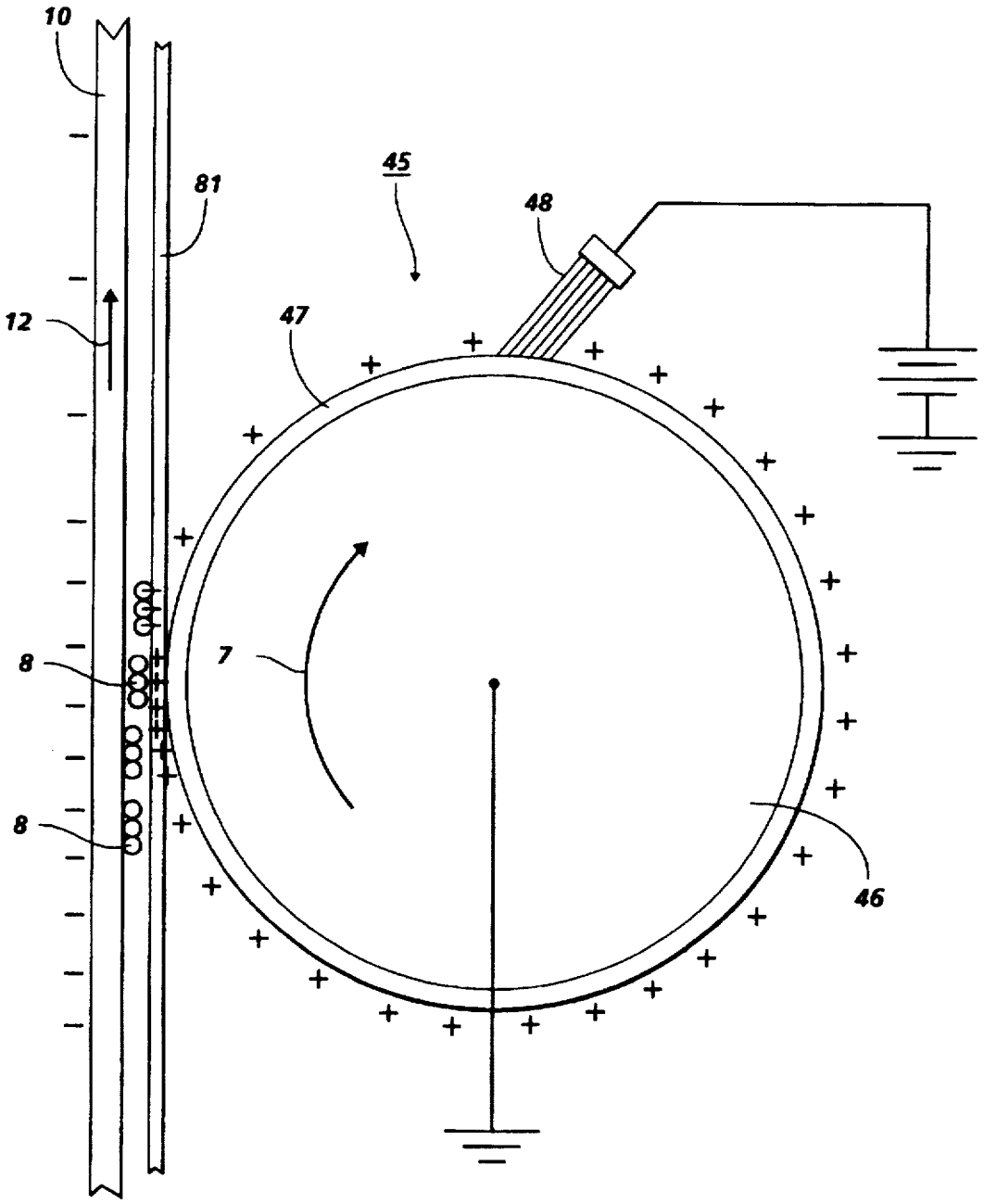
FIG. 2 is a partial exploded elevational view showing the biased transfer roller mechanism used in the FIG. 1 printing machine to press the copy sheet against the developed image in the transfer station.
Figure 3:
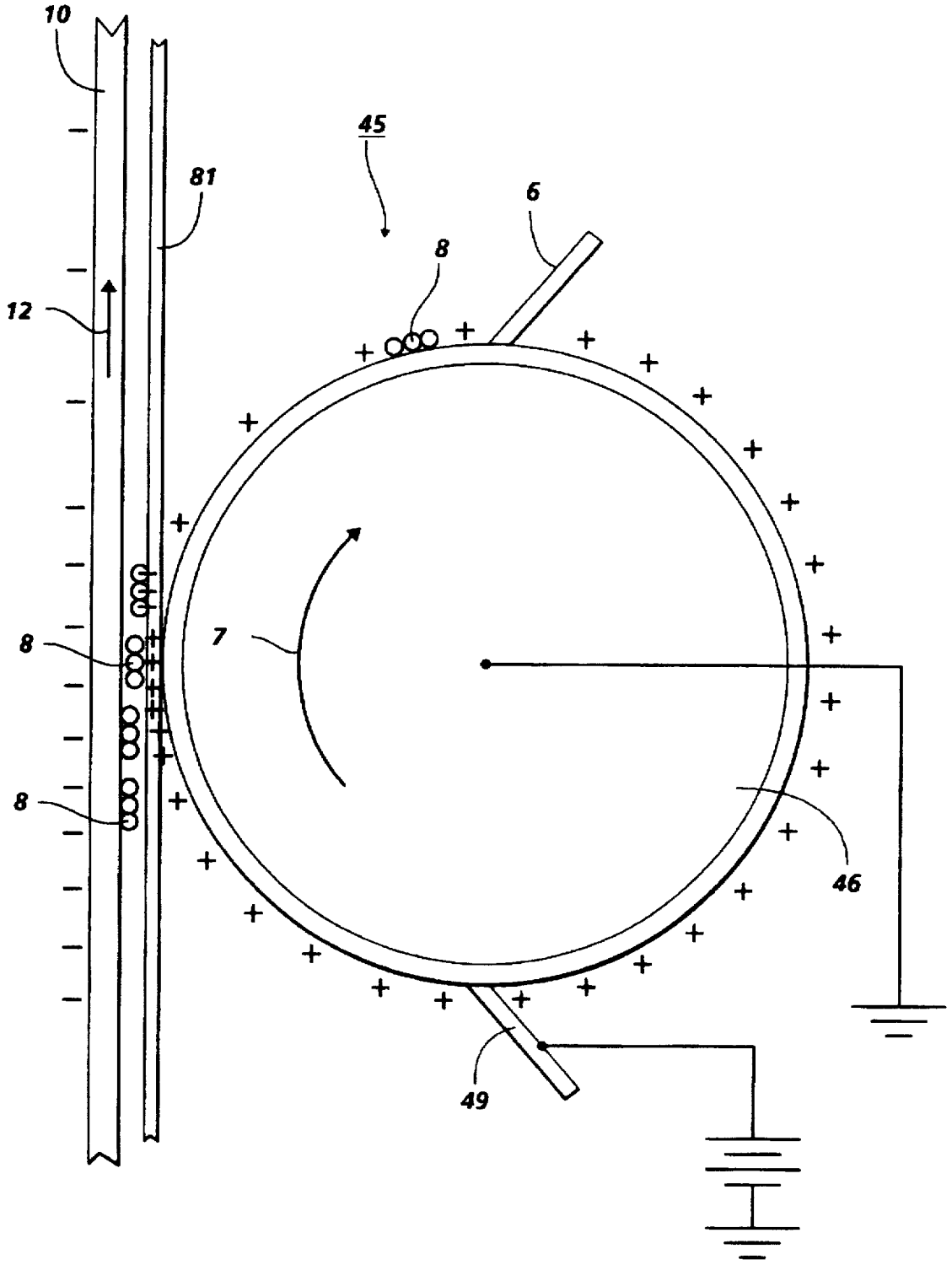
Figure 4:
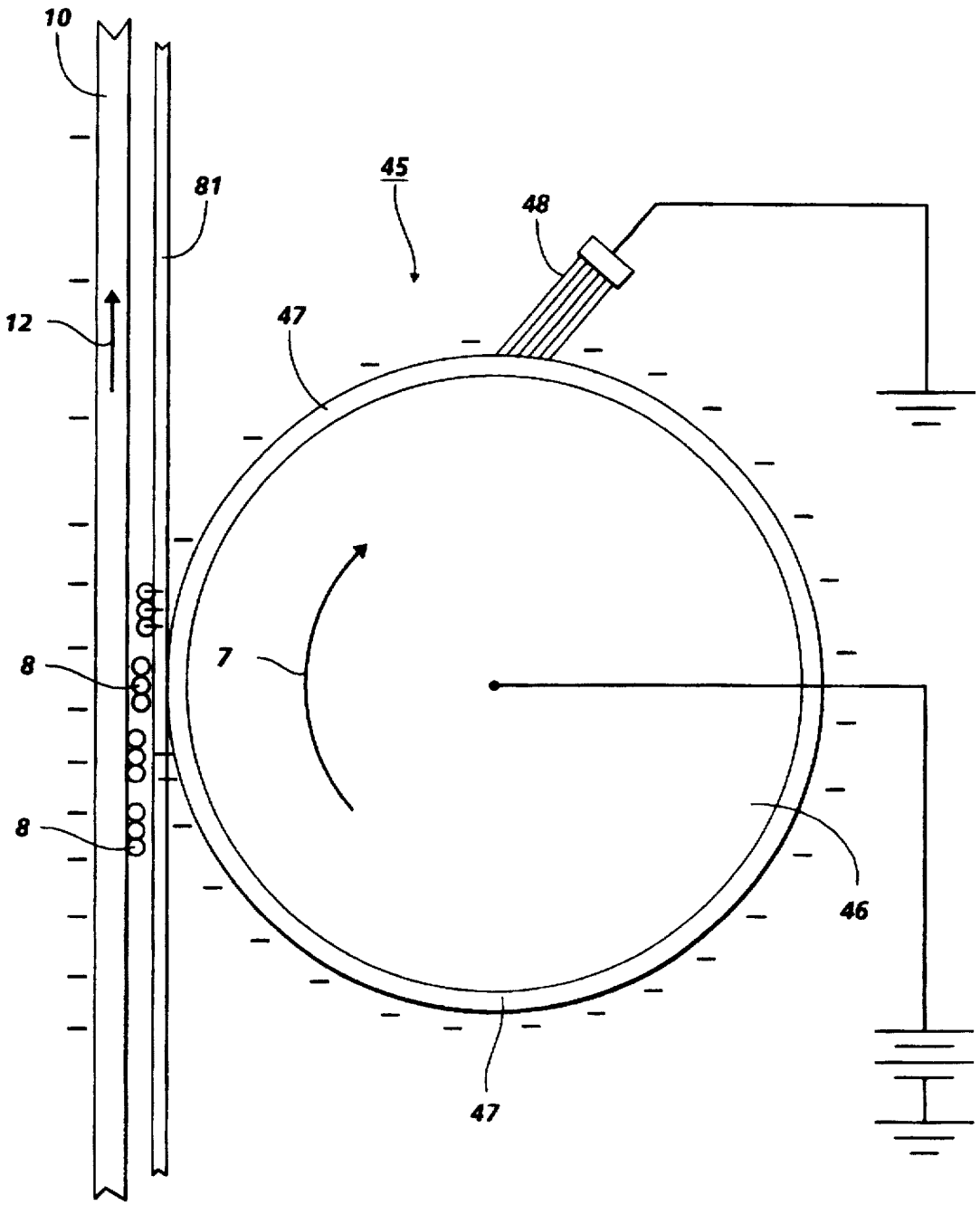

FIG. 3 is a partial exploded elevational view of the transfer apparatus of FIG. 2, showing the use of a charging blade and a cleaning blade in conjunction with a transfer roller; and FIG. 4 is a partial, exploded elevational view of an alternative embodiment of the transfer apparatus of the present invention showing a D.C. bias applied to a transfer roller and a grounded brush contacting an overcoating on the transfer roller.

Figure 5:
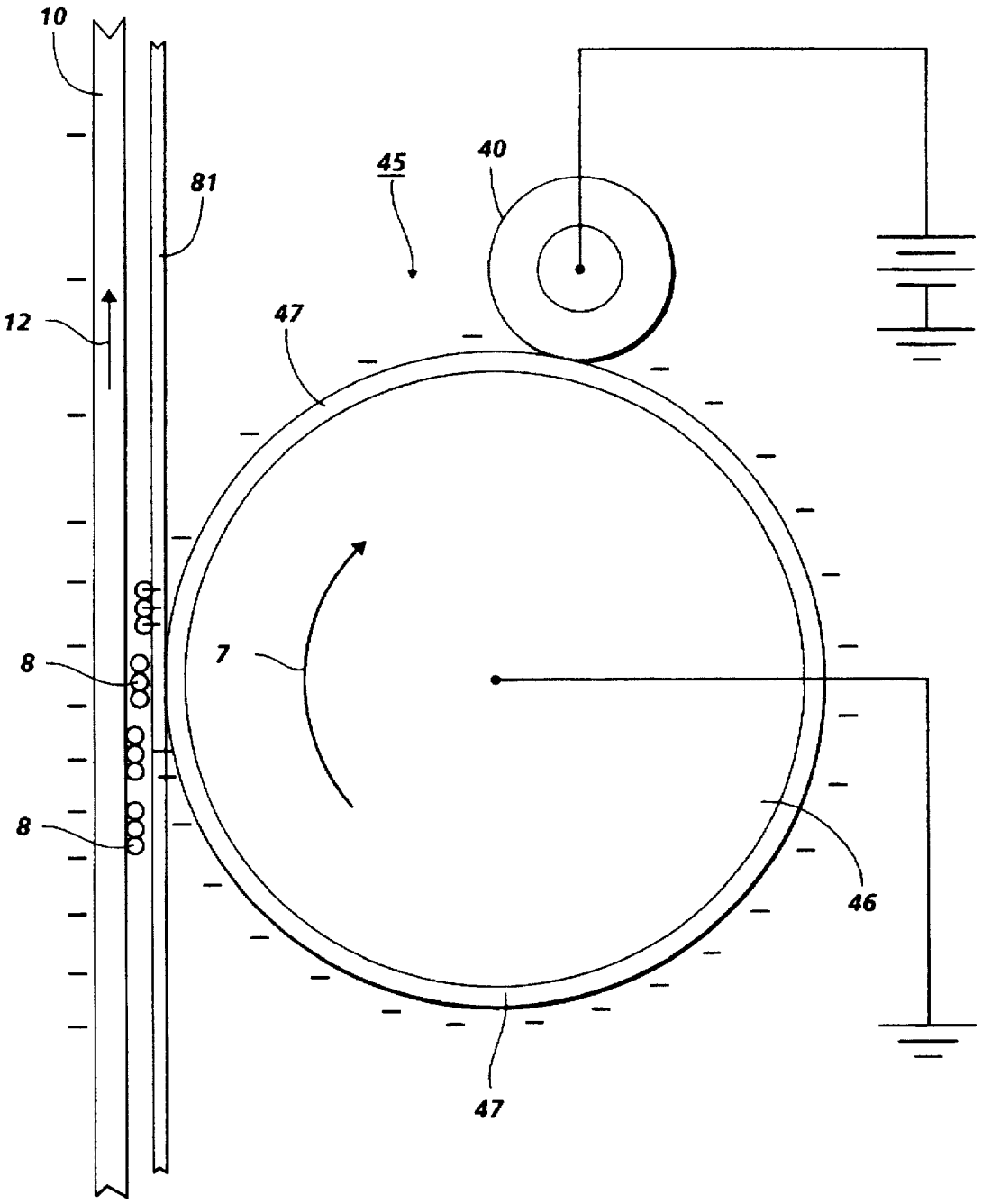

FIG. 5 is a partial, exploded elevational view of an alternative embodiment of the transfer apparatus of the present invention showing a transfer roller and a D.C. bias applied to a charging roller contacting an overcoating on the transfer roller.

While the present invention will hereinafter be described in connection with a preferred embodiment and method of use, it will be understood that it is not intended to limit the invention to that embodiment or method of use. On the contrary, it is intended to cover all alternatives, modifications, and equivalents, as may be included within the spirit and scope of the invention as defined by the appended claims.

Figure 1:
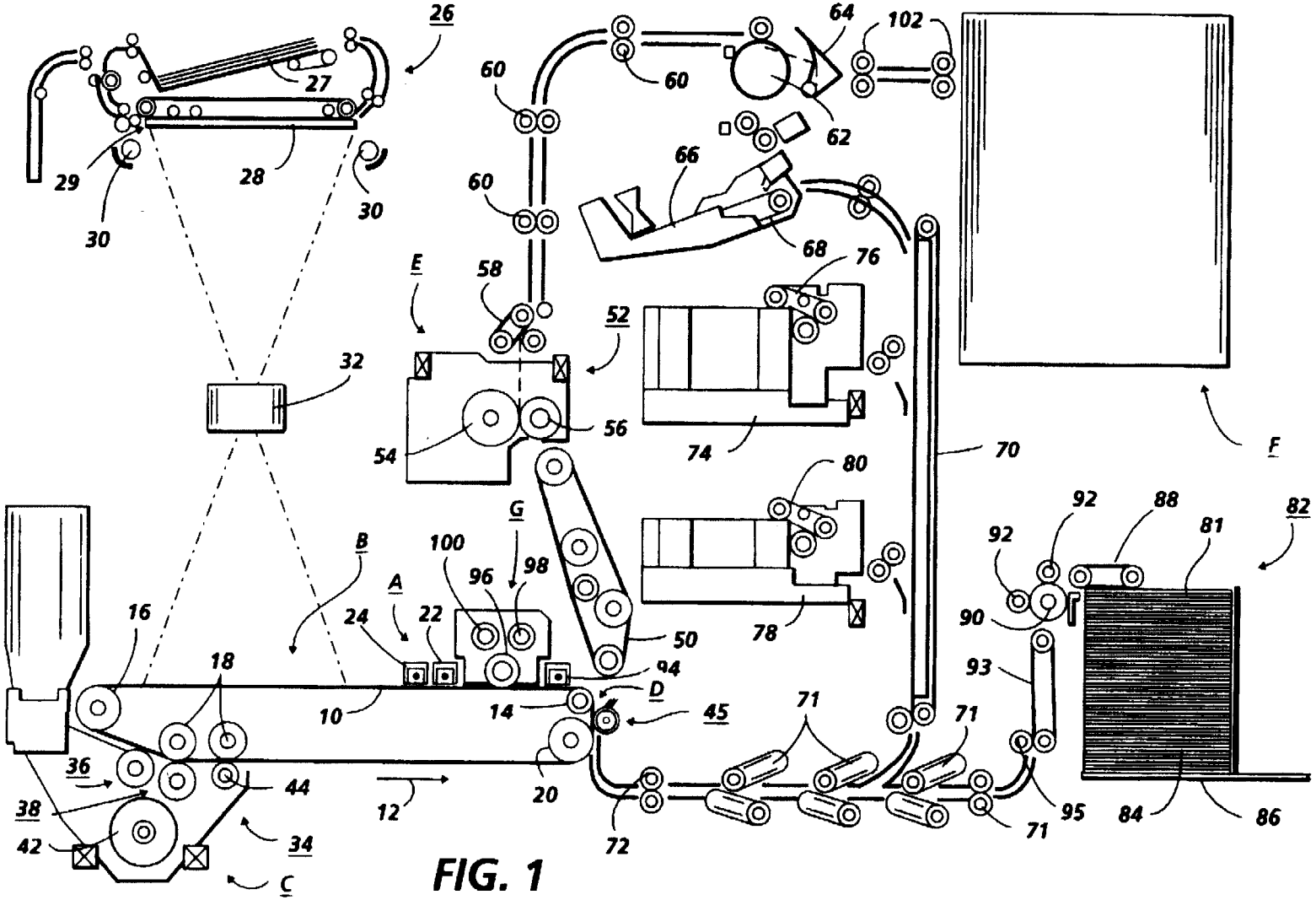
FIG. 1 is a schematic elevational view depicting an illustrative electrophotographic printing machine incorporating the transfer device of the present invention therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the apparatus of the present invention may be employed in a wide variety of electrostatographic printing machines and is not specifically limited in its application to the particular embodiment or method of use described herein.

Referring now to FIG. 1 of the drawings, the electrophotographic printing machine employs a photoconductive belt 10. Preferably, the charge retentive photoconductive belt 10 is made from a photoconductive material coated on a ground layer, which, in turn, is coated on an anti-curl backing layer. The photoconductive material is made from a transport layer coated on a generator layer. The transport layer transports positive charges from the generator layer. The interface layer is coated on the ground layer. The transport layer contains small molecules of di-m-tolydiphenylbiphenyldiamine dispersed in a polycarbonate. The generation layer is made from trigonal selenium. The grounding layer is made from a titanium coated Mylar. The ground layer is very thin and allows light to pass therethrough. Other suitable photoconductive materials, ground layers, and anti-curl backing layers may also be employed. Belt 10 moves in the direction of arrow 12 to advance successive portions of the photoconductive surface sequentially through the various processing stations disposed about the path of movement thereof. Belt 10 is entrained about stripping roller 14, tensioning roller 16, rollers 18, and drive roller 20. Stripping roller 14 and rollers 18 are mounted rotatably so as to rotate with belt 10. Tensioning roller 16 is resiliently urged against belt 10 to maintain belt 10 under the desired tension. Drive roller 20 is rotated by a motor coupled thereto by suitable means such as a belt drive. As roller 20 rotates, it advances belt 10 in the direction of arrow 12.

Initially, a portion of photoconductive belt 10 passes through charging station A. At charging station A, two corona generating devices, indicated generally by the reference numerals 22 and 24 charge photoconductive belt 10 to a relatively high, substantially uniform potential. Corona generating device 22 places all of the required charge on photoconductive belt 10. Corona generating device 24 acts as a leveling device, and fills in any areas missed by corona generating device 22.

Next, the charged portion of photoconductive belt 10 is advanced through imaging station B. At imaging station B, a document handling unit, indicated generally by the reference numeral 26, is positioned over platen 28 of the printing machine. Document handling unit 26 sequentially feeds documents from a stack of documents placed by the operator in the document stacking and holding tray. The original documents to be copied are loaded face up into the document tray on top of the document handling unit. A document feeder, located below the tray, feeds the bottom document in the stack to rollers. The rollers advance the document onto platen 28. When the original document is properly positioned on platen 28, a belt transport is lowered onto the platen with the original document being interposed between the platen and the belt transport. After imaging, the original document is returned to the document tray from platen 28 by either of two paths. If a simplex copy is being made or if this is the first pass of a duplex copy, the original document is returned to the document tray via the simplex path. If this is the inversion pass of a duplex copy, then the original document is returned to the document tray through the duplex path. Imaging of a document is achieved by two Xenon flash lamps 30 mounted in the optics cavity which illuminate the document on platen 28. Light rays reflected from the document are transmitted through lens 32. Lens 32 focuses the light image of the original document onto the charged portion of the photoconductive surface of belt 10 to selectively dissipate the charge thereon. This records an electrostatic latent image on photoconductive belt 10 which corresponds to the informational areas contained within the original document. Thereafter, photoconductive belt 10 advances the electrostatic latent image recorded thereon to development station C.

At development station C, a magnetic brush developer unit, indicated generally by the reference numeral 34, has three developer rolls, indicated generally by the reference numerals 36 and 38. A paddle wheel 42 picks up developer material and delivers it to the developer rolls. When developer material reaches rolls 36 and 38, it is magnetically split between the rolls with half of the developer material being delivered to each roll. Photoconductive belt 10 is partially wrapped about rolls 36 and 38 to form extended development zones. Magnetic roll 44 is a carrier granule removal device adapted to remove any carrier granules adhering to belt 10. Thus, rolls 36 and 38 advance developer material into contact with the electrostatic latent image. The latent image attracts toner particles from the carrier granules of the developer material to form a toner powder image on the photoconductive surface of belt 10. Belt 10 then advances the toner powder image to transfer station D.

At transfer station D, a copy sheet is moved into contact with the toner powder image. The copy sheet is frequently wrinkled. First, photoconductive belt 10 is exposed to a pre-transfer light from a lamp (not shown) to reduce the attraction between photoconductive belt 10 and the toner powder image. The copy sheet is advanced along the sheet path and pressed into contact with the toner powder image on photoconductive surface 10 by a biased transfer apparatus, indicated generally by the reference numeral 45. Biased transfer apparatus 45 includes a roller which presses the copy sheet into contact with the toner powder image developed on photoconductive belt 10. This substantially eliminates any spaces between the copy sheet and the toner powder image. The continuous pressing of the sheet into contact with the toner powder image at the transfer station insures that the copy sheet is substantially wrinkle free at the transfer station. Corona generated by the biased transfer roll charges the copy sheet to the proper magnitude and polarity so that the copy sheet is tacked to photoconductive belt 10 and the toner powder image attracted from the photoconductive belt to the copy sheet. In this way, the copy sheet moves with photoconductive belt 10, in the direction of arrow 12. Further details of this apparatus will be described hereinafter with reference to FIG. 2.

After transfer, the beam strength of the copy sheet provides the detachment forces enabling detack from belt 10. Conveyor 50, positioned to receive the copy sheet, advances it to fusing station E.

Fusing station E includes a fuser assembly, indicated generally by the reference numeral 52, which permanently affixes the transferred toner powder image to the copy sheet. Preferably, fuser assembly 52 includes a heated fuser roller 54 and a pressure roller 56 with the powder image on the copy sheet contacting fuser roller 54. The pressure roller is cammed against the fuser roller to provide the necessary pressure to fix the toner powder image to the copy sheet. The fuser roll is internally heated by a quartz lamp. Release agent, stored in a reservoir, is pumped to a metering roll. A trim blade trims off the excess release agent. The release agent is transferred to a donor roll and then to the fuser roll.

After fusing, the copy sheets are fed through a decurler 58. Decurler 58 bends the copy sheet in one direction to put a known curl in the copy sheet and then bends it in the opposite direction to remove that curl.

Forwarding roller pairs 60 then advance the sheet to duplex turn roll 62. Duplex solenoid gate 64 guides the sheet to the finishing station F or to duplex tray 66. In the finishing station, the copy sheets are collected in sets with the copy sheets of each set being stapled or glued together. Alternatively, duplex solenoid gate 64 diverts the sheet into duplex tray 66. The duplex tray 66 provides an intermediate or buffer storage for those sheets that have been printed on one side and on which an image will be subsequently printed on the second, opposed side thereof, i.e. the sheets being duplexed. The sheets are stacked in duplex tray 66 face down on top of one another in the order in which they are copied.

In order to complete duplex copying, the simplex sheets in tray 66 are fed, in seriatim, by bottom feeder 68 from tray 66 back to transfer station D via conveyor 70, and rollers 72, for transfer of the toner powder image to the opposed sides of the copy sheets. Inasmuch as successive bottom sheets are fed from duplex tray 66, the proper or clean side of the copy sheet is positioned in contact with belt 10 at transfer station D so that the toner powder image is transferred thereto. The duplex sheet is then fed through the same path as the simplex sheet to be advanced to finishing station F.

Copy sheets are fed to transfer station D from the secondary tray 74. Secondary tray 74 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 76. Sheet feeder 76 is a friction retard feeder utilizing a feed belt and take-away rolls to advance successive copy sheets to transport 70 which advances the sheets to rolls 72 and then to transfer station D.

Copy sheets may also be fed to transfer station D from the auxiliary tray 78. The auxiliary tray 78 includes an elevator driven by a bidirectional AC motor. Its controller has the ability to drive the tray up or down. When the tray is in the down position, stacks of copy sheets are loaded thereon or unloaded therefrom. In the up position, successive copy sheets may be fed therefrom by sheet feeder 80. Sheet feeder 80 is a friction retard feeder utilizing a feed belt and take-away rolls to advance successive copy sheets to transport 70 which advances the sheets to rolls 72 and then to transfer station D.

Secondary tray 74 and auxiliary tray 78 are secondary sources of copy sheets. A high capacity feeder, indicated generally by the reference numeral 82, is the primary source of copy sheets. High capacity feeder 82 includes a tray 84 supported on an elevator 86. The elevator is driven by a bidirectional motor to move the tray up or down. In the up position, the copy sheets are advanced from the tray to transfer station D. A vacuum feed belt 88 feeds successive uppermost sheets from the stack to a take away roll 90 and rolls 92. The take-away roll 90 and rolls 92 guide the sheet onto transport 93. Transport 93 and roll 95 advance the sheet to rolls 72 which, in turn, move the sheet into the transfer zone at transfer station D Invariably, after the copy sheet is separated from photoconductive belt 10, some residual particles remain adhering thereto. After transfer, photoconductive belt 10 passes beneath corona generating device 94 which charges the residual toner particles to the proper polarity. Thereafter, the pre-charge erase lamp (not shown), located inside photoconductive belt 10, discharges the photoconductive belt in preparation for the next charging cycle. Residual particles are removed from the photoconductive surface at cleaning station G. Cleaning station G includes an electrically biased cleaner brush 96 and two de-toning rolls 98 and 100, i.e. waste and reclaim de-toning rolls. The reclaim roll is electrically biased negatively relative to the cleaner roll so as to remove toner particles therefrom. The waste roll is electrically biased positively relative to the reclaim roll so as to remove paper debris and wrong sign toner particles. The toner particles on the reclaim roll are scraped off and deposited in a reclaim auger (not shown), where it is transported out of the rear of cleaning station G.

The various machine functions are regulated by a controller. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the documents and the copy sheets. In addition, the controller regulates the various positions of the gates depending upon the mode of operation selected.

Referring now to FIGS. 2 and 3, there is shown an elevational view further illustrating the features of the present invention. As shown thereat, bias transfer roller apparatus 45 has a highly insulating overcoating 47 placed on top of grounded transfer roller core 46. The bias transfer roller is a two piece member consisting of a support 46 and an insulating overcoating 47 on the support that is thin and can range, for example, from about 0.0001 inches to about 0.02 inches in thickness. The insulating overcoating can be a relatively soft dielectric film, such as, yellow beeswax, carnauba wax, low molecular weight plastics (e.g., polyethelyne, polycarbonate), mylar or a very hard material, such as, anodized aluminum, ceramic, high molecular weight plastics, varnishes or glass. BTR Roller 45 is small in comparison to conventional BTRs and has a diameter of between about 1/16 to about ¾ inch in diameter, preferably about ½ inch in diameter thereby reducing the effect in distance over which image degradation can occur in the pre and post nip zones. The roller is contact charged by brush 48 in FIG. 2 and a blade 49 in FIG. 3 and rotates in the direction of arrow 7. In FIG. 3, a metal cleaning blade is employed to remove any toner 8 accidentally contacting roller 45. The cleaning feature of FIG. 2 can be accomplished by biased brush charging member 48 although additional vacuum cleaning of the brush may be used to remove particles, if desired. It is also contemplated that a single metal blade can perform both the charging and cleaning functions, such as, the cleaning blade 6 in FIG. 3. Roller 45 contacts the back of copy sheet 81 transferring charges that migrate through the copy sheet to enable transfer. Tests have shown that only a thousand volts of charge to the transfer roller will enable transfer. This gives rise to a novel feature of the present invention in that a limited number of charges are deposited on the surface of the insulator at the charging station. If the roller should contact the photoconductive surface, no sustained arc is possible since there is no reservoir of charge to maintain the arc, therefore, no damage to the photoconductive surface takes place. The roller 45 to photoconductive surface 10 rotation may be synchronous or asynchronous which produces an asymmetrical charge distribution that is beneficial in some applications. There is no electrical connection between the transfer roller nip and the contact charging station, and therefore, the limited number of charges deposited on the surface of the roller 45 at the charging station are carried to the transfer station, thereby transferring some of these limited number of charges that migrate through the copy sheet to enable transfer of the developed image to the copy sheet. Thus, the contact charging means of the present invention charges the transfer roller by contact therewith without generating and maintaining current in pre-transfer, transfer nip or post-transfer nip regions. Another way biased transfer roller 45 can be used is spaced from photoconductive surface 10. This non-contact method can have sufficient surface charge to produce ionization in the gap between the photoconductive surface and the biased transfer roller. This will also supply a charge limited transfer current.

An alternative embodiment of the transfer apparatus of the present invention is shown in FIG. 4 and includes the apparatus of FIG. 2 with a positive DC bias to core member 46 of transfer roller 45 of approximately 2 kV. By applying a DC bias to the transfer roller and grounding brush 48, some negative charges deposit on the outer insulator surface 47. These opposite sign charges affect the transfer field, such that the transfer field is between conductive roller 45 and the ground plane of photoconductor 10 or alternatively, the opposite sign charge produces a bias transfer roller surface which is more positive relative to the ground plane of photoconductor 10. This induces charge separation within the copy sheet 81 with negative charges forming on the bias transfer roller side, and positive charges forming on the photoconductor side. These positive charges assist in forming fields to provide transfer. By discharging the photoconductive surface 10 prior to transfer, with light or AC charges, the field holding the toner to the photoconductive surface 10 will be reduced thereby allowing lower transfer voltage/fields to be used. In a test of this system in a Xerox® 3100 machine with a transfer roller having a 3 mil (0.003 inches) mylar overcoat and a conductive discharging brush, excellent transfer was obtained with a positive 2000 volts applied to the transfer roller. No pre or post nip breakdown was observed for cockle, folded or perforated copy sheets. The alternative embodiment of the present invention shown in FIG. 5 is the same as that shown in FIG. 2 except that biased brush 48 of FIG. 2 had been replaced with biased roller 40. The apparatus of FIG. 2 is included here with grounded core member 46 of transfer roller 45. By applying a DC bias to the charging roller 40 and grounding core member 46, some positive charges deposit on the outer insulator surface 47. These opposite sign charges affect the transfer field, such that the transfer field is between conductive roller 45 and the ground plane of photoconductor 10.

In recapitulation, the transfer apparatus of the present invention includes a transfer roller that is overcoated with an insulator and charged by either a brush, roller or a blade. In all of the above embodiments, the transfer roller is preferably one shaft with a thin overcoating. The shaft can extend right out to the bearings and drive of the printer. The transfer core member or shaft 46 can be solid or a hollow cylinder, e.g., a tube and must be conductive. The biased roller is brought into contact with the back of a copy sheet thereby transferring charges that migrate through the copy sheet to enable toner transfer to the copy sheet. A metal blade can be used for both charging and cleaning the transfer roller, if desired.

It is, therefore, evident that there has been provided, in accordance with the present invention, an apparatus that fully satisfies the aims and advantages hereinbefore set forth. While this invention has been described in conjunction with a preferred embodiment and method of use, it is evident that many alternatives, modifications, and variations will be apparent to those skilled in the art. Accordingly, it is intended to embrace all such alternatives, modifications and variations as fall within the spirit and broad scope of the appended claims.

We claim:

1. An apparatus for transferring a developed image from a moving charge retentive surface to a moving copy sheet at a transfer nip, including:

non-pivotable, biasable grounded transfer roller means fixedly positioned in a predetermined relationship with respect to the charge retentive surface for charging the copy sheet to attract the developed image from the photoconductive surface to the copy sheet, said transfer roller means having a core member and an insulating overcoating material positioned on said core member; and means for charging said transfer roller means by contact therewith without generating and maintaining current in pre-transfer nip, transfer nip or post-transfer nip regions, thereby transferring charges that migrate through the copy sheet to enable transfer of the developed image to the copy sheet, said means for charging said transfer roller means being positioned at a point removed from where transfer of the developed images occurs.

2. The apparatus of claim 1, wherein said overcoating material is one of a group comprising anodized aluminum, ceramic, plastics, varnishes, waxes or glass.

3. The apparatus of claim 1, wherein said overcoating material is one of a group comprising yellow beeswax, carnauba wax, polyethylene, polycarbonate or polyethylene terephthalates.

4. The apparatus of claim 1, wherein said means for charging said transfer roller is a biased brush.

5. The apparatus of claim 1, wherein said means for charging said transfer roller is a metal blade.

6. The apparatus of claim 5, wherein said metal blade cleans said transfer roller.

7. The apparatus of claim 1, wherein said transfer roller is charged to about 1000 volts.

8. The apparatus of claim 1, wherein said transfer roller means is in contact with the moving copy sheet.

9. The apparatus of claim 1, wherein said transfer roller means is spaced from said photoconductive surface.

10. The apparatus of claim 1, wherein said overcoating material has a thickness of from about 0.0001 to about 0.02 inches.

11. The apparatus of claim 1, wherein said means for charging said transfer roller is a biased roller.

12. The apparatus of claim 1, wherein said biasable transfer roller has a diameter of between about 1/16 to about ¾ inches.

13. The apparatus of claim 1, wherein said biasable transfer roller has a diameter of about ½ inch.

14. The apparatus of claim 1, wherein said biasable transfer roller has a diameter of about 1/16 inch.

15. An apparatus for transferring a developed image from a moving charge retentive surface to a moving copy sheet at a transfer nip, including:

non-movable, biasable grounded transfer roller means positioned in a predetermined fixed relationship with respect to the charge retentive surface for charging the copy sheet to attract the developed image from the photoconductive surface to the copy sheet, said transfer roller means having a core member and an insulating overcoating material positioned on said core member; and means for charging said transfer roller means through said core member, thereby transferring charges that migrate through the copy sheet to enable transfer of the developed image, said means for charging said transfer roller means being positioned at a point removed from where transfer of the developed images occurs, and adapted to charge said transfer roller without generating and maintaining current in pre-transfer nip, transfer nip or post-transfer nip regions.

16. The apparatus of claim 15, including grounded brush means for cleaning said transfer roller.

17. The apparatus of claim 16, wherein said core member is biased to about a positive 2 kV.

18. The apparatus of claim 15, wherein said overcoating material has a thickness of from about 0.0001 to about 0.02 inches.

19. An electrophotographic printing machine of the type in which a developed image is transferred from a moving charge retentive surface to a moving copy sheet at a transfer station, wherein the improvement includes:

non-movable, biasable grounded transfer roller means positioned in a predetermined fixed relationship with respect to the charge retentive surface for charging the copy sheet to attract the developed image from the photoconductive surface to the copy sheet, said transfer roller means having a core member and an insulating overcoating material positioned on said core member; and means for charging said transfer roller means by contact therewith, thereby transferring charges that migrate through the copy sheet to enable transfer of the developed image, said means for charging said transfer roller means being positioned at a point removed from where transfer of the developed images occurs, and adapted to charge said transfer roller without generating and maintaining current in pre-transfer nip, transfer nip or post-transfer nip regions.

20. The apparatus of claim 19, wherein said overcoating material is one of a group consisting of anodized aluminum, ceramic, plastics varnishes or glass.

21. The apparatus of claim 19, wherein said means for charging said transfer roller is a biased brush.

22. The apparatus of claim 19, wherein said means for charging said transfer roller is a metal blade.

23. The apparatus of claim 22, wherein said metal blade cleans said transfer roller.

24. The apparatus of claim 19, wherein said means for charging said transfer roller charges said transfer roller to about 1000 volts.

25. The apparatus of claim 19, wherein said overcoating material is one of a group comprising yellow beeswax, aranauba wax, polyethylene polycarbonate or polyethylene terephthalates.

26. The apparatus of claim 19, wherein said overcoating material has a thickness of from about 0.0001 to about 0.02 inches.

27. The apparatus of claim 19, wherein said means for charging said transfer roller is a biased roller.

28. The apparatus of claim 19, wherein said biasable transfer roller has a diameter of between about 1/16 to about ¾ inch.

29. The apparatus of claim 19, wherein said biasable transfer roller has a diameter of about ½ inch.

30. The apparatus of claim 19, wherein said biasable transfer roller has a diameter of about 1/16 inch.

31. The apparatus of claim 19, wherein said biasable transfer roller is spaced from said charge retentive surface.

* * * * *